US009080774B2

(12) United States Patent
Kim et al.

(10) Patent No.: US 9,080,774 B2
(45) Date of Patent: Jul. 14, 2015

(54) COOKER

(75) Inventors: Yangho Kim, Seoul (KR); Jungwan Ryu, Seoul (KR); Yoonseob Eom, Seoul (KR)

(73) Assignee: LG Electronics Inc., Seoul (KR)

( * ) Notice: Subject to any disclaimer, the term of this patent is extended or adjusted under 35 U.S.C. 154(b) by 629 days.

(21) Appl. No.: 13/446,980

(22) Filed: Apr. 13, 2012

(65) Prior Publication Data

US 2012/0266860 A1 Oct. 25, 2012

(30) Foreign Application Priority Data

Apr. 19, 2011 (KR) ..... 10-2011-0036423

(51) Int. Cl.
*F24C 3/08* (2006.01)

(52) U.S. Cl.
CPC ..... *F24C 3/087* (2013.01)

(58) Field of Classification Search
CPC ..... F24C 3/00; F24C 3/02; F24C 3/027; F24C 3/047; F24C 3/087; F24C 314/025
USPC ..... 126/273 R
See application file for complete search history.

(56) References Cited

U.S. PATENT DOCUMENTS 3,114,363 A * 12/1963 Koltun ..... 126/41 R
3,320,943 A * 5/1967 Crannell et al. ..... 126/39 E
3,338,231 A * 8/1967 Lamar ..... 126/39 E
3,417,742 A * 12/1968 Perl ..... 126/21 A
3,422,810 A * 1/1969 Weiss ..... 126/41 R
3,496,926 A * 2/1970 Kemp et al. ..... 126/39 E
3,530,278 A * 9/1970 Tilus ..... 219/393
3,530,847 A * 9/1970 Saponara et al. ..... 126/21 R
3,590,804 A * 7/1971 Welshofer et al. ..... 126/11
3,590,805 A * 7/1971 Perl ..... 126/21 A
3,596,651 A * 8/1971 Welshofer et al. ..... 126/190
3,624,742 A * 11/1971 Hurko et al. ..... 126/39 D
RE27,254 E * 12/1971 Lamar ..... 126/279
3,645,248 A * 2/1972 Kemp ..... 126/39 E
3,682,156 A * 8/1972 Perl ..... 126/21 A
3,915,149 A * 10/1975 Kemp ..... 126/273 R
3,951,335 A * 4/1976 Kemp ..... 236/15 A
RE29,602 E * 4/1978 Perl ..... 126/21 A
4,375,213 A * 3/1983 Kemp et al. ..... 126/21 A
4,598,691 A * 7/1986 Herrelko et al. ..... 126/41 R
4,763,638 A * 8/1988 Hurley et al. ..... 126/21 A
4,796,600 A * 1/1989 Hurley et al. ..... 126/273 A
4,802,459 A * 2/1989 McFadden et al. ..... 126/41 R
5,078,121 A * 1/1992 Ha ..... 126/41 R
5,492,055 A * 2/1996 Nevin et al. ..... 99/331
2003/0037780 A1 * 2/2003 Wiersma et al. ..... 126/21 R

* cited by examiner

*Primary Examiner* — Jorge Pereiro
(74) *Attorney, Agent, or Firm* — Birch, Stewart, Kolasch & Birch, LLP

(57) ABSTRACT

A cooker is provided. The cooker includes a casing defining an exterior of the cooker, a cavity part disposed in the casing, the cavity part including a cooking chamber having an interior to receive food, a burner disposed in the cooking chamber to burn a mixture gas of air and gas so as to supply energy to the interior of the cooking chamber, a compartment member dividing the interior of the cooking chamber into a food cooking region and a gas mixing region where air and gas are supplied to form a mixture gas, and a door configured to selectively close or open the cooking chamber. A portion of air flowing in the casing is supplied to the gas mixing region.

11 Claims, 8 Drawing Sheets

COOKER

CROSS-REFERENCE TO RELATED APPLICATIONS

The present application claims priority under 35 U.S.C. 119 to Korean Patent Application No. 10-2011-0036423, filed on Apr. 19, 2011, which is hereby incorporated by reference in its entirety.

BACKGROUND OF THE DISCLOSURE

1. Field of the Disclosure

The present disclosure relates generally to a cooker having a cooking chamber and, more particularly, a cooker having a compartment member dividing the cooking chamber into a food cooking region and a gas mixing region.

2. Description of Related Art

Cookers are used to cook food by heating the food using gas or electricity. Cookers using gas as fuel include a burner for heating food by burning gas. For example, an infrared burner provides thermal energy necessary for heating food by burning a mixture of air and gas on the surface of a combustion member. Such an infrared burner is usually disposed in a cooking chamber in which food is placed for cooking. The infrared burner includes a mixing tube for mixing air and gas and supplying the mixed air and gas. The mixing tube extends from the inside of the cooking chamber to an inner region of a cooker to receive air.

Cookers of the related art may have several disadvantages. As described above, since a mixing tube extends to the outside of a cooking chamber, a space corresponding to the protruded length of the mixing tube is necessary at the backside of the cooking chamber. In other words, the volume of the cooking chamber is reduced by the protruded length of the mixing tube.

A combustion member of an infrared burner is formed of a porous material for discharging mixture gas therethrough. Thus, if food is cooked in a cooking chamber by using another heating source instead of using the infrared burner, exhaust gas may flow into the infrared burner through the combustion member. In this case, the exhaust gas may flow to the inside of a cooker through the mixing tube to contaminate the inside of the cooker or damage components of the cooker.

Moreover, in the related art, a nozzle through which gas is supplied to the mixing tube is disposed in the cooking chamber. Therefore, repairing or replacing of the nozzle has to be performed at the backside of the cooker. That is, since the cooker has to be moved, it may be difficult or troublesome to repair or replace the nozzle.

BRIEF SUMMARY OF THE DISCLOSURE

Exemplary embodiments provide a cooker in which a relatively large cavity part can be formed.

Exemplary embodiments also provide a cooker in which exhaust gas is prevented from flowing from a cooking chamber to the inside of the cooker through a burner for preventing contamination of the inside of the cooker.

Exemplary embodiments also provide a cooker where the burner of the cooker can be repaired or replaced more easily.

In one exemplary embodiment, a cooker is provided. The cooker includes a casing defining an exterior of the cooker, a cavity part disposed in the casing, the cavity part including a cooking chamber having an interior to receive food, a burner disposed in the cooking chamber to burn a mixture gas of air and gas so as to supply energy to the interior of the cooking chamber, a compartment member dividing the interior of the cooking chamber into a food cooking region and a gas mixing region where air and gas are supplied to form a mixture gas, and a door configured to selectively close or open the cooking chamber. A portion of air flowing in the casing is supplied to the gas mixing region.

In another exemplary embodiment, a cooker includes a casing defining an exterior of the cooker, a cavity part disposed in the casing, the cavity part including a cooking chamber having an interior to receive food, a broil burner disposed in the cooking chamber to burn a mixture gas of air and gas so as to supply energy to an inside of the cooking chamber for cooking food, a compartment member dividing the interior of the cooking chamber into a food cooking region and a gas mixing region where air and gas are supplied to form a mixture gas, a burner cover disposed at a lower side of the cavity part to define a burner chamber between a bottom surface of the cavity part and an inner surface of the burner cover, a bake burner disposed in the burner chamber to heat air to be supplied to the food cooking region, and a door configured to selectively close or open the cooking chamber. A portion of air flowing in the casing is supplied to the gas mixing region.

In yet another exemplary embodiment, a cooker includes a casing defining an exterior of the cooker, a cavity part disposed in the casing, the cavity part including a cooking chamber having an interior to receive food, a compartment member dividing the interior of the cooking chamber into a food cooking region and a gas mixing region where air and gas are supplied to form the mixture gas, a burner including a mixing tube in which air and gas are mixed to provide the mixture gas, the burner being configured to burn the mixture gas to supply energy to the food cooking region, a nozzle configured to inject gas into the gas mixing region, and a door configured to selectively close or open the cooking chamber. When the burner is operated, a portion of the air flowing in the casing is supplied to the gas mixing region to form the mixture gas and another portion of the air flowing in the casing is supplied to the food cooking region for combustion of the mixture gas.

The details of one or more exemplary embodiments are set forth in the accompanying drawings and the description below. Other features will be apparent from the description and drawings, and from the claims.

BRIEF DESCRIPTION OF THE DRAWINGS

The present disclosure will become more fully understood from the detailed description given hereinbelow and the accompanying drawings which are given by way of illustration only, and thus are not limitative of the present disclosure and wherein.

DETAILED DESCRIPTION OF THE DISCLOSURE

Hereinafter, an explanation will be given of an exemplary structure of a cooker according to a first exemplary embodiment with reference to the accompanying drawings.

Figure 1:
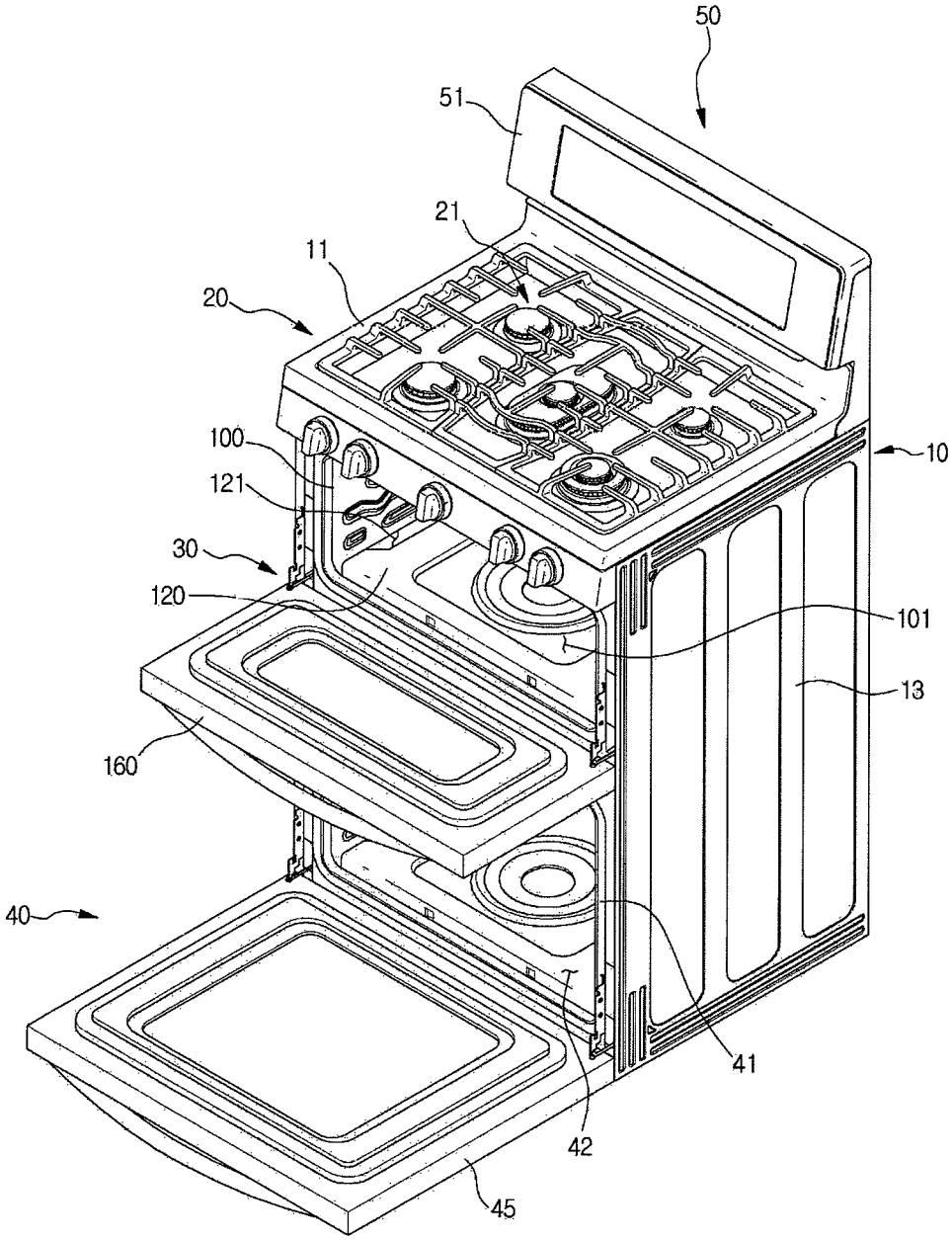
FIG. 1 is a perspective view illustrating a cooker according to a first exemplary embodiment.
Figure 2:
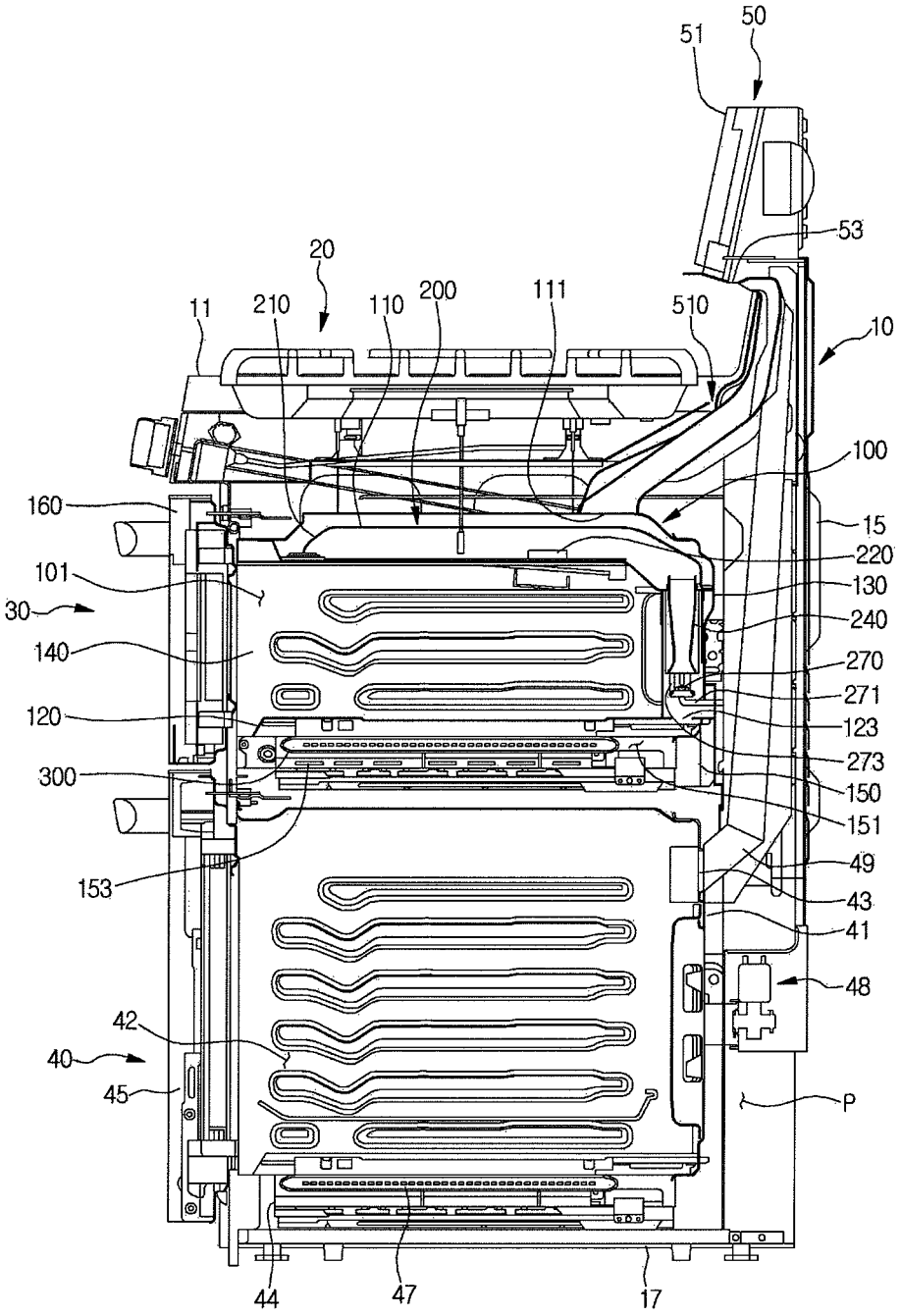
FIG. 2 is a vertical sectional view illustrating main parts of the cooker of the first exemplary embodiment.
Figure 3:
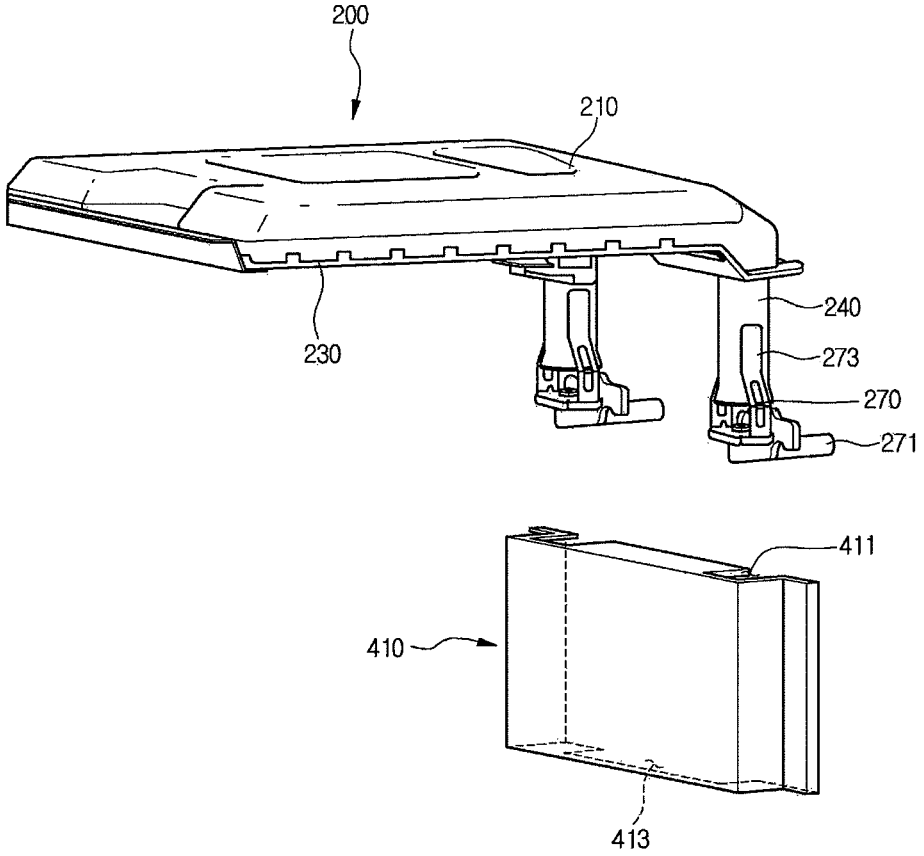
FIG. 3 is an exploded perspective view illustrating main parts of the cooker of the first exemplary embodiment.
Figure 4:
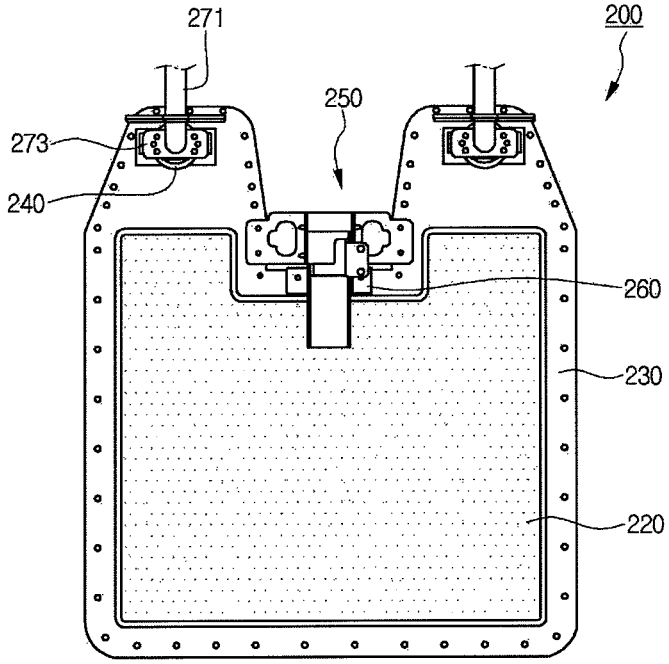
FIG. 4 is a plan view illustrating an upper broil burner according to the first exemplary embodiment.

FIG. 1 is a perspective view illustrating a cooker according to a first exemplary embodiment; FIG. 2 is a vertical sectional view illustrating main parts of the cooker of the first exemplary embodiment; FIG. 3 is an exploded perspective view illustrating main parts of the cooker of the first exemplary embodiment; and FIG. 4 is a plan view illustrating an upper broil burner 200 according to the first exemplary embodiment.

Referring to FIGS. 1 to 3, the cooker includes a casing 10 forming the exterior of the cooker. The casing 10 has an approximately hexahedral shape with front openings. A top plate 11 is disposed on the topside of the casing 10. A rear end part of the top plate 11 is bent upward at a preset angle, for example, right angle. Side panels 13 are disposed on both sides of the casing 10, and a back cover 15 is disposed on the backside of the casing 10. A bottom plate 17 is disposed on the bottom side of the casing 10. Intake inlets (not shown) are formed in both lateral ends of the bottom plate 17 so that air can be sucked or drawn into the casing 10.

A flow passage (P) is formed in the casing 10. Air sucked into the casing 10 through the intake inlets is guided along the flow passage (P). The flow passage (P) may be formed between the back cover 15 and rear sides of upper and lower cavity parts 100 and 41 (described later). In addition, the flow passage (P) may be formed between the side panels 13 and both sides of the upper and lower cavity parts 100 and 41.

A cooktop 20, an upper oven 30, a lower oven 40, and a control part 50 are provided on or in the casing 10. The cooktop 20 is disposed on the topside of the casing 10. The upper oven 30 and the lower oven 40 are disposed in the casing 10. The control part 50 is disposed on a rear end of the topside of the casing 10.

More particularly, the cooktop 20 includes a plurality of cooktop burners 21. The cooktop burners 21 are disposed on the topside of the casing 10. That is, the cooktop burners 21 are disposed on the topside of the top plate 11. As mixture gas discharged through the cooktop burners 21 is combusted, containers in which foods are contained may be heated by flames generating as a result of the combustion.

The upper oven 30 is disposed in the casing 10 under the cooktop 20. The upper oven 30 includes: the upper cavity part 100 in which an upper oven chamber 101 is formed; a burner cover 150 disposed on the bottom side of the upper cavity part 100; an upper door 160 used to selectively open and close the upper oven chamber 101; an upper heating source configured to heat the inside of the upper oven chamber 101 for cooking food; and an upper exhaust duct 510 through which exhaust gas is discharged to the outside of the upper oven chamber 101. Herein, the term exhaust gas is used to indicate a gaseous matter such as gas generated as a result of combustion, steam, smoke, fumes, and a remaining air-gas mixture.

The upper cavity part 100 has an approximately hexahedral shape with an opened front side. The upper cavity part 100 may be disposed in the casing 10 under the top plate 11. The topside, bottom side, rear side, and both lateral sides of the upper cavity part 100 are formed by an upper plate 110, a base plate 120, a rear plate 130, and side plates 140, respectively.

An upper exhaust outlet 111 formed in the upper plate 110. Exhaust gas is discharged from the upper oven chamber 101 through the upper exhaust outlet 111. The upper exhaust outlet 111 may be formed by cutting a portion of the upper plate 110.

Heat supply openings 121 are formed in the base plate 120. High-temperature air is supplied from a burner chamber 151 (described later) to the upper oven chamber 101 through the heat supply openings 121. The heat supply openings 121 are formed in both lateral end parts of the base plate 120. The heat supply openings 121 may extend in a front-to-rear direction. In addition, secondary air is supplied to the upper broil burner 200 (described later) substantially through the heat supply openings 121. Thus, the heat supply openings 121 may be referred to as secondary air supply openings.

Air supply openings 123 are formed in the base plate 120. The air supply openings 123 may be formed by cutting a portion of a rear end part of the base plate 120. Air is supplied from the burner chamber 151 to the upper broil burner 200 through the air supply openings 123. Generally, primary air is supplied through the air supply openings 123 to the upper broil burner 200. Thus, the air supply openings 123 may be referred to as primary air supply openings.

In the current exemplary embodiment, the base plate 120 is formed as a separate part and is fixed to the upper cavity part 100. That is, in the current exemplary embodiment, the upper cavity part 100 has a polyhedral shape with opened front and bottom sides. The bottom side of the upper cavity part 100 is formed by the base plate 120 fixed to the upper cavity part 100. However, in other exemplary embodiments, the base plate 120 and the upper cavity part 100 may be formed as one piece.

The burner cover 150 defines the base plate 120 and the burner chamber 151. An upper bake burner 300 (described later) is disposed in the burner chamber 151. The burner cover 150 is disposed on the bottom side of the upper cavity part 100 (that is, on the base plate 120) so as to cover the air supply openings 123. Generally, the upper oven chamber 101 and the burner chamber 151 communicate with each other through the air supply openings 123. In addition, a plurality of air supply holes 153 is formed in the burner cover 150. Air is supplied from the inside of the casing 10 to the burner chamber 151 through the air supply holes 153. That is, some of air sucked into the casing 10 through the intake inlets is supplied to the burner chamber 151 through the air supply holes 153.

The upper heating source includes the upper broil burner 200 and the upper bake burner 300. The upper broil burner 200 heats food disposed in the upper oven chamber 101 by radiation. The upper bake burner 300 heats air supplied into the upper cavity part 100. In the current exemplary embodiment, the upper broil burner 200 and the upper bake burner 300 may be alternately operated. That is, in the upper oven chamber 101, food may be cooked by the upper broil burner 200 or the upper bake burner 300.

The upper broil burner 200 is disposed in an upper region of the upper oven chamber 101. In the current exemplary embodiment, an infrared burner may be used as the upper broil burner 200. More particularly, the upper broil burner 200 includes a burner port 210, a combustion member 220, a port cover 230, mixing tubes 240, an ignition unit 250, and a gas guide member 260.

The burner port 210 has an approximately polyhedral shape with an opened bottom side. A mixture of gas and air is supplied into the burner port 210.

The combustion member 220 is disposed on the bottom surface of the burner port 210. The combustion member 220 may be formed of a porous material such as a ceramic material. Mixture gas supplied into the burner port 210 is burned on the surface of the combustion member 220 as the mixture gas passes through the combustion member 220. Generally, the combustion member 220 blocks a flow passage formed in the burner port 210. While mixture gas is burned on the surface of the combustion member 220 as described above, secondary air is supplied through the heat supply openings 121.

The port cover 230 fixes the combustion member 220 disposed on the bottom surface of the burner port 210. For this, the port cover 230 is fixed to the burner port 210 after the combustion member 220 is placed on the bottom surface of the burner port 210.

Gas and air are mixed in the mixing tubes 240 and then supplied to the burner port 210. In the current exemplary embodiment, two mixing tubes 240 extend downward from the bottom rear end of the burner port 210. The mixing tubes 240 may be fixed to the bottom surface of the burner port 210 by welding or using fasteners. In a state where the upper broil burner 200 is disposed in the upper oven chamber 101, lower ends of the mixing tubes 240 are disposed close to the air supply openings 123. That is, primary air is supplied to the mixing tubes 240 from the air supply openings 123.

The ignition unit 250 ignites mixture gas flowing on the surface of the combustion member 220. The ignition unit 250 is fixed to a side of the port cover 230 and is spaced a predetermined distance from the combustion member 220 in a downward direction.

Mixture gas discharged through a predetermined region of the combustion member 220 is guided to the ignition unit 250 by the gas guide member 260. The gas guide member 260 is fixed to a position of the burner port 210 close to the ignition unit 250.

Gas is injected into the mixing tubes 240 through nozzles 270. For this, the nozzles 270 are coupled to gas pipes 271 which extend into the upper oven chamber 101 through the rear plate 130. In the current exemplary embodiment, the nozzles 270 are fixed to the mixing tubes 240 by nozzle holders 273. The nozzles 270 are spaced a predetermined distance from the bottom ends of the mixing tubes 240. Gas injected through the nozzles 270 is supplied into the mixing tubes 240 together with primary air supplied along the air supply openings 123.

Referring again to FIGS. 1 to 3, the upper bake burner 300 is disposed in the burner chamber 151. A general gas burner including a plurality of flame holes may be used as the upper bake burner 300. Generally, the upper bake burner 300 may heat air in the burner chamber 151.

In the current exemplary embodiment, a barrier member 410 is disposed in the upper oven chamber 101. As a result of the barrier member 410, air and gas to be mixed and supplied into the upper broil burner 200 can be prevented from being heated by a high-temperature atmosphere in the upper oven chamber 101. That is, the barrier member 410 may block flows of air from the inside of the upper oven chamber 101 into the mixing tubes 240. For this, the barrier member 410 divides the inside of the upper oven chamber 101 into a region for cooking a food and a region for supplying air and gas. Therefore, the barrier member 410 may be referred to as a compartment member. In the following description, one of the inside regions of the upper oven chamber 101 defined by the barrier member 410 will be referred to as a cooking region, and the other will be referred to as a mixing region. In the cooking region, food may be cooked, and in the mixing region, air and gas may be supplied. The mixing tubes 240 and the nozzles 270 are disposed substantially in the mixing region.

In the current exemplary embodiment, the barrier member 410 has a polyhedral shape with an opened rear side. In addition, the barrier member 410 is fixed to the front side of the rear plate 130. The topside of the barrier member 410 is disposed on the bottom side of the upper broil burner 200, that is, the bottom side of the port cover 230. The bottom side of the barrier member 410 is disposed on the topside of the base plate 120. Communication openings 411 are formed in the top surface of the barrier member 410, and a communication opening 413 is formed in the bottom surface of the barrier member 410.

When the barrier member 410 is installed, the mixing tubes 240 are disposed through the communication openings 411. The communication openings 411 may be formed by cutting top surface portions of the barrier member 410 to the rear end of the barrier member 410. Therefore, when the upper broil burner 200 is disposed in the upper oven chamber 101 and the barrier member 410 is fixed to the rear plate 130, the mixing tubes 240 are disposed in the communication openings 411.

At this time, the communication opening 413 communicates with the air supply openings 123. Therefore, a space defined by the front side of the rear plate 130 and the inner surface of the barrier member 410 is isolated from the upper oven chamber 101 where food may be cooked, but the space communicates with the burner chamber 151 through the air supply openings 123. The mixing tubes 240 are disposed in the space between the rear plate 130 and the barrier member 410.

In the current exemplary embodiment, after the upper broil burner 200 is disposed in the upper oven chamber 101, the barrier member 410 is fixed to the front side of the rear plate 130. The nozzles 270 are disposed closed to the mixing tubes 240 by the nozzle holders 273 before the barrier member 410 is fixed to the rear plate 130.

Exhaust gas of the upper oven chamber 101 is discharged to the outside of the casing 10 through the upper exhaust duct 510. In other words, exhaust gas of the upper oven chamber 101 flows along the upper exhaust duct 510 and is then discharged to the outside of the casing 10. The lower end of the upper exhaust duct 510 communicates with the upper exhaust outlet 111, and the upper end of the upper exhaust duct 510 communicates with an exhaust slot 53.

The lower oven 40 is disposed in the casing 10 under the upper oven 30. That is, the upper oven 30 and the lower oven 40 are arranged in a vertically stacked manner. The lower oven 40 includes the lower cavity part 41 in which a lower oven chamber 42 is formed, a burner cover 44 disposed on the bottom side of the lower cavity part 41, a lower door 45 used to selectively open and close the lower oven chamber 42, a lower heating source configured to heat the inside of the lower oven chamber 42 for cooking food, and a lower exhaust duct 49 through which exhaust gas is discharged to the outside of the lower oven chamber 42.

Generally, the lower cavity part 41 is disposed under the upper cavity part 100. Like the upper cavity part 100, the lower cavity part 41 has a hexahedral shape with an opened front side. In the current exemplary embodiment, the height of the lower cavity part 41 is greater than that of the upper cavity part 100. A lower exhaust outlet 43 is formed in a rear surface of the lower cavity part 41. Exhaust gas is discharged from the lower oven chamber 42 through the lower exhaust outlet 43.

For example, the lower heating source may include a lower bake burner 47 and a convection device 48. The lower bake burner 47 and the convection device 48 are identical to those of a related-art oven. Thus, detailed descriptions thereof will be omitted.

Exhaust gas of the lower oven chamber 42 is discharged to the outside of the casing 10 through the lower exhaust duct 49. For this, the lower end of the lower exhaust duct 49 is connected to the lower exhaust outlet 43. In addition, the upper end of the lower exhaust duct 49 is connected to a side of the upper exhaust duct 510. Therefore, exhaust gas of the lower oven chamber 42 may be discharged to the outside of the casing 10 sequentially through the lower exhaust duct 49, the upper exhaust duct 510, and the exhaust slot 53.

The control part 50 is disposed at the rear side of the top plate 11. That is, the control part 50 is disposed at the rear end of the topside of the casing 10. The control part 50 is used to receive commands or signals for operating the upper oven 30 and the lower oven 40 and display operational states of the upper oven 30 and the lower oven 40.

The front and lateral sides of the control part 50 are formed by a control panel 51. The front lower end of the control panel 51 is spaced a preset distance from an upper end of the top plate 11. Thus, a predetermined gap is formed between the upper end of the top plate 11 and the front lower end of the control panel 51. In the following description, the gap between the top plate 11 and the control panel 51 will be referred to as the exhaust slot 53. Exhaust gas of the upper oven chamber 101 and lower oven chamber 42 is discharged to the outside of the casing 10 through the exhaust slot 53.

Hereinafter, an exemplary operation of the cooker of the first exemplary embodiment will be described in detail with reference to the accompanying drawings.

Figure 5:
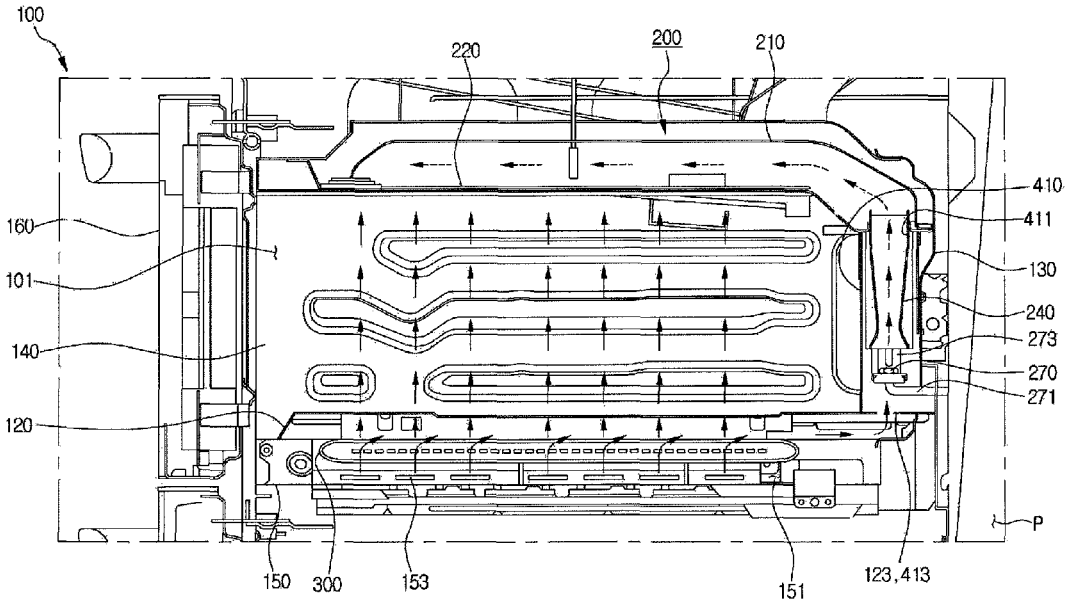
FIG. 5 is a vertical sectional view illustrating air flows in an upper oven of the cooker according to the first exemplary embodiment.

FIG. 5 is a vertical sectional view illustrating air flows in the upper oven 30 of the cooker according to the first exemplary embodiment.

Referring to FIG. 5, food can be cooked in the upper oven chamber 101 by using the upper broil burner 200 but not using the upper bake burner 300. In the operation of the upper broil burner 200, mixture gas is burned on the surface of the combustion member 220, and thus the food disposed in the upper oven chamber 101 can be cooked by heat from the burning mixture gas.

For this, air necessary for combustion of mixture gas in the upper broil burner 200 is sucked into the casing 10 through the intake inlets. Some of air sucked into the casing 10 is supplied as primary air into the burner chamber 151 through the air supply holes 153. Then, the primary air is supplied from the burner chamber 151 to the mixing tubes 240 through the air supply openings 123. At this time, the primary air is supplied from the air supply openings 123 to the mixing tubes 240 together with gas injected through the nozzles 270. The gas and the primary air supplied into the mixing tubes 240 as described above are mixed with each other while flowing along the mixing tubes 240, and are supplied into the upper broil burner 200 in the form of mixture gas.

The mixture gas supplied into the upper broil burner 200 through the mixing tubes 240 flows in the burner port 210. Then, the mixture gas is discharged through the combustion member 220. As the mixture gas is discharged through the combustion member 220, the mixture gas is ignited by the ignition unit 250. As a flame propagates from the ignition unit 250, the mixture gas can be burned on the entire region of the combustion member 220. At this time, the rest of the air sucked in the burner chamber 151 is supplied as secondary air into the upper oven chamber 101 through the heat supply openings 121.

Hereinafter, an explanation will be given of an exemplary structure of a cooker according to a second exemplary embodiment with reference to the accompanying drawings.

Figure 6:
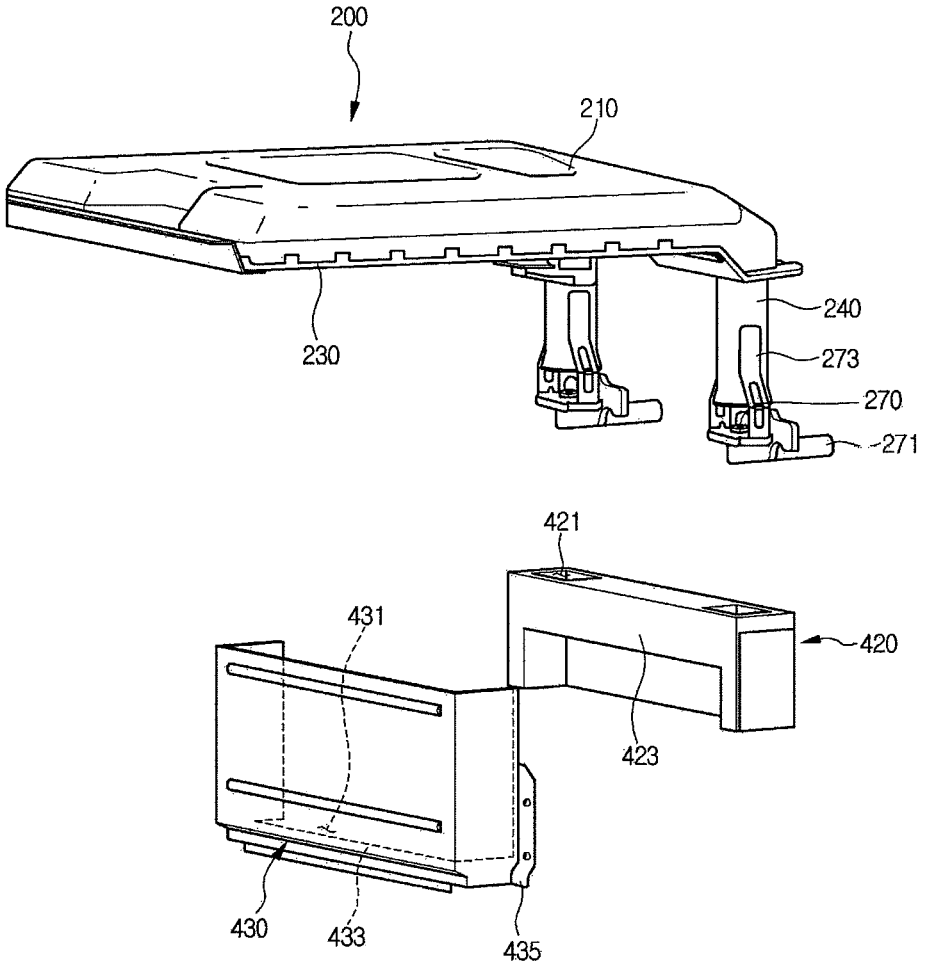
FIG. 6 is an exploded perspective view illustrating main parts of a cooker of a second exemplary embodiment.

FIG. 6 is an exploded perspective view illustrating main parts of the cooker of the second exemplary embodiment. In the current exemplary embodiment, the same elements as those of the first exemplary embodiment will be denoted by the same reference numerals used in FIGS. 1 to 5, and detailed descriptions thereof will not be repeated.

Referring to FIG. 6, a first barrier member 420 and a second barrier member 430 are disposed in the upper oven chamber 101. The first and second barrier members 420 and 430 have the same function as that of the barrier member 410 of the first exemplary embodiment. That is, the first and second barrier members 420 and 430 prevent flows of air from the upper oven chamber 101 to the mixing tubes 240 so as to suppress heat transfer from the inside of the upper oven chamber 101 to mixture gas that will be supplied to an upper broil burner 200.

In detail, the first barrier member 420 has a polyhedral shape with an opened bottom side. The rear side of the first barrier member 420 is disposed on or fixed to the rear surface of the upper oven chamber 101 (that is, the front surface of the rear plate 130), for example, by welding or using fasteners. At this time, the bottom side of the first barrier member 420 is disposed above the base plate 120 substantially at the upper side of the air supply openings 123.

First communication openings 421 are formed in the top surface of the first barrier member 420. When the first barrier member 420 is installed, the mixing tubes 240 are disposed in the first communication openings 421. The first communication openings 421 may be formed by cutting top portions of the first barrier member 420. A first contact bracket 423 is disposed on the front side of the first barrier member 420. The first contact bracket 423 is brought into contact with a front inner surface of the second barrier member 430. Therefore, the first and second barrier members 420 and 430 may make surface contact with each other through the first contact bracket 423. By bringing the first contact bracket 423 into contact with the second barrier member 430, a gap between the first and second barrier members 420 and 430 may be efficiently shielded. In the current exemplary embodiment, the first contact bracket 423 is disposed above the nozzles 270 through which gas is injected into the mixing tubes 240. In other words, the front sides of the nozzles 270 are not blocked by the first contact bracket 423 but are exposed. For example, a portion of the front side of the first barrier member 420 may be cut off to expose the front sides of the nozzles 270, and the other portion of the front side of the first barrier member 420 may form the first contact bracket 423.

The second barrier member 430 has a polyhedral shape with opened top and rear sides. The second barrier member 430 shields the first barrier member 420 and is fixed to the front surface of the rear plate 130. Thus, the positions of the mixing tubes 240 may be determined by the rear plate 130, the first barrier member 420, and the second barrier member 430.

A second communication opening 431 is formed through the bottom side of the second barrier member 430. A second contact bracket 433 is disposed on the bottom side of the second barrier member 430. The second communication opening 431 communicates with the air supply openings 123. The second contact bracket 433 makes contact with the top surface of the base plate 120 at a position close to the air supply openings 123. Therefore, as a result of the second contact bracket 433, a gap between the base plate 120 and the second barrier member 430 can be efficiently shielded. For example, the second communication opening 431 may be formed by cutting a rear end portion of the bottom side of the second barrier member 430, and the rest of the bottom side of the second barrier member 430 may form the second contact bracket 433.

In addition, fixation flanges 435 are provided on both rear ends of the second barrier member 430. The fixation flanges 435 extend outward from both rear ends of the second barrier member 430. The fixation flanges 435 are used to fix the second barrier member 430 to the rear plate 130. For example, the fixation flanges 435 may be fixed to the rear plate 130 by bringing the fixation flanges 435 into contact with the front surface of the rear plate 130 and securing the fixation flanges 435 to the front surface of the 130 by welding or using fasteners.

According to the current exemplary embodiment, if the second bather member 430 is detached from the upper cavity part 100, the nozzles 270 can be exposed. Therefore, the nozzles 270 can be repaired or replaced in a state where the upper broil burner 200 is not detached.

In the current exemplary embodiment, the gap between the first and second barrier members 420 and 430 and the gap between the base plate 120 and the second barrier member 430 can be efficiently shielded. Therefore, flows of air from the inside of the upper oven chamber 101 into the mixing tubes 240 can be prevented more efficiently.

Generally, the first barrier member 420 is disposed in the second barrier member 430. Therefore, the first and second barrier members 420 and 430 may be referred to as inner and outer barrier members, respectively.

Hereinafter, an explanation will be given of a cooker according to a third exemplary embodiment with reference to the accompanying drawings.

Figure 7:
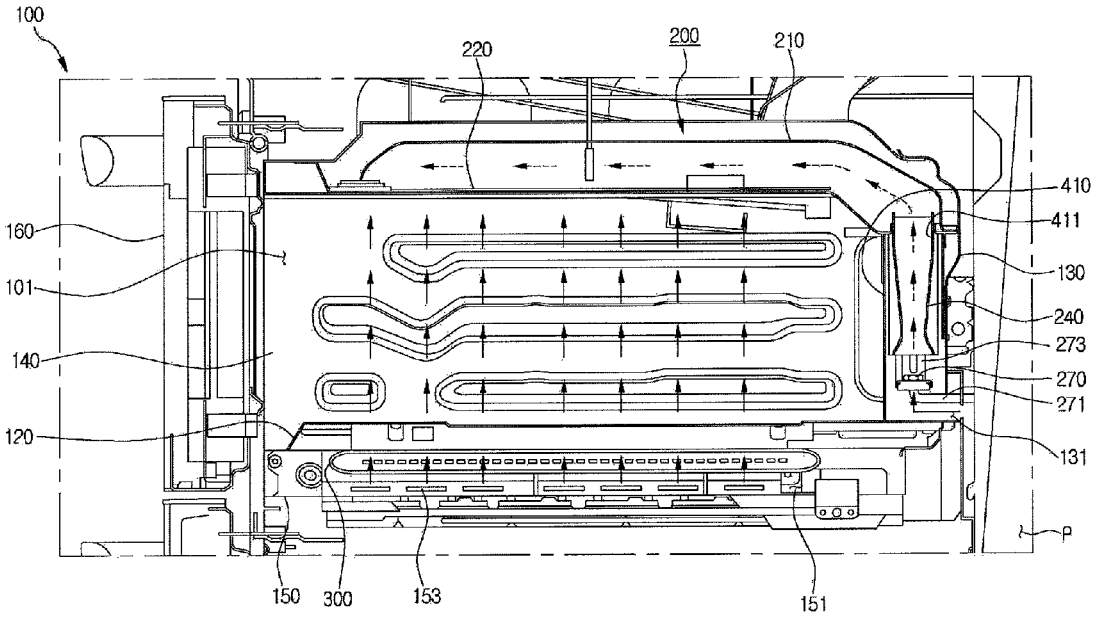
FIG. 7 is a vertical sectional view illustrating main parts of a cooker according to a third exemplary embodiment.

FIG. 7 is a vertical sectional view illustrating main parts of a cooker according to a third exemplary embodiment. In the third exemplary embodiment, the same elements as those of the first exemplary embodiment will be denoted by the same reference numerals used in FIGS. 1 to 5, and detailed descriptions thereof will not be repeated.

Referring to FIG. 7, air supply openings 131 are formed in a rear surface of the upper cavity part 100 (that is, in a side of the rear plate 130) to supply air to the upper broil burner 200. In other words, the current exemplary embodiment is different from the first exemplary embodiment in that the air supply openings 131 are formed in the rear plate 130 instead of forming them in the base plate 120.

Therefore, in the current exemplary embodiment, the mixing tubes 240 are substantially disposed in regions defined by the rear plate 130, the base plate 120, and the barrier member 410. The air supply openings 131 are formed at predetermined positions of the rear plate 130 so that the air supply openings 131 can communicate with the regions defined by the rear plate 130, the base plate 120, and the barrier member 410.

In the current exemplary embodiment, air flowing in the casing 10 (that is, in the flow passage (P) of the casing 10) is supplied to the mixing tubes 240 through the air supply openings 131. Therefore, according to the current exemplary embodiment, an air passage to the upper broil burner 200 may be relatively simple as compared with that in the first exemplary embodiment. Thus, air may be supplied to the upper broil burner 200 more efficiently.

Hereinafter, an explanation will be given of a cooker according to a fourth exemplary embodiment with reference to the accompanying drawings.

Figure 8:
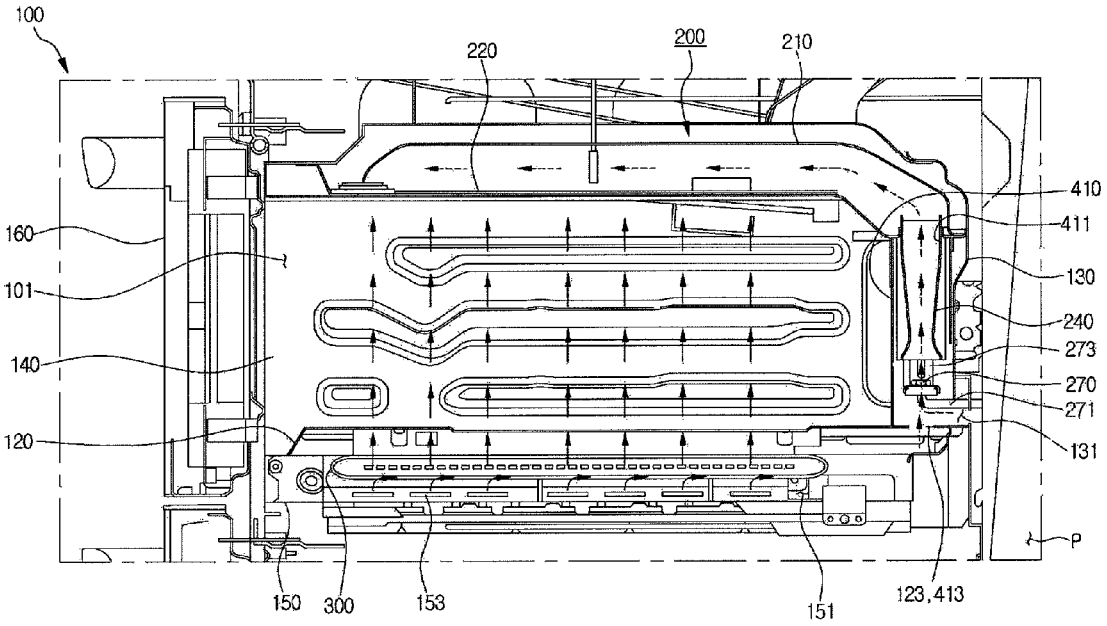
FIG. 8 is a vertical sectional view illustrating main parts of a cooker according to a fourth exemplary embodiment.

FIG. 8 is a vertical sectional view illustrating main parts of a cooker according to a fourth exemplary embodiment. In the fourth exemplary embodiment, the same elements as those of the first exemplary embodiment will be denoted by the same reference numerals used in FIGS. 1 to 5, and detailed descriptions thereof will not be repeated.

Referring to FIG. 8, air supply openings 123 and 131 are formed in the base plate 120 and the rear plate 130, respectively, so as to supply air to the upper broil burner 200. That is, the air supply openings 123 are formed in the base plate 120, and the air supply openings 131 are formed in the rear plate 130.

Air supplied into the burner chamber 151 through the air supply openings 123 is supplied to the upper broil burner 200. In addition, air flowing in the casing 10 (that is, in the flow passage (P) of the casing 10) is supplied to the upper broil burner 200 through the air supply openings 131. Therefore, according to the current exemplary embodiment, a relatively large amount of air may be supplied to the upper broil burner 200 as compared with the cases of the previous exemplary embodiments. Particularly, if the upper broil burner 200 is an infrared burner, a mixture gas having a high air/gas ratio is necessary. In the current exemplary embodiment, since a relatively large amount of air can be supplied to the upper broil burner 200, mixture gas may be burned in the upper broil burner 200 more efficiently and safely.

According to the cooker of the present disclosure, the following effects can be obtained.

The mixing tube is vertically disposed in the cooking chamber and has a vertically long shape to supply mixture gas into the burner. Therefore, the mixing tube can be disposed within a relatively smaller space, and thus the size of the cavity part (that is, the volume of the cooking chamber) can be increased.

In addition, according to the present disclosure, although exhaust gas flows into the burner from the inside of the cooking chamber, the exhaust gas cannot flow into the cooker. Therefore, the inside of the cooker may not be contaminated and components of the cooker may not be damaged due to backflow of exhaust gas.

In addition, according to the present disclosure, the nozzle can be repaired or replaced from the front side of the cooking chamber after detaching the barrier member. That is, components such as the nozzle can be easily repaired or replaced.

Although exemplary embodiments have been described with reference to a number of illustrative exemplary embodiments thereof, it should be understood that numerous other modifications and exemplary embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

In the above-described exemplary embodiments, the terms upper and lower oven chambers are used to denote spaces for cooking food. Thus, the upper and lower oven chambers may also be referred to as upper and lower cooking chambers, respectively.

In the above-described exemplary embodiments, the upper heating source includes the upper broil burner and the upper bake burner. In addition, the upper heating source may further include a convection device. Similarly, the lower heating source may further include a lower broil burner. In addition, one of the lower bake burner and the convection device of the lower heating source may be omitted. Moreover, like the upper broil burner, the upper bake burner, the lower broil burner, and the lower bake burner may be infrared burners.

In the above-described exemplary embodiments, the upper exhaust outlet is the upper surface of the upper cavity part. However, the upper exhaust outlet may be formed in the rear surface of the upper cavity part according to the size of the upper cavity part.

The disclosure thus being described, it will be obvious that the same may be varied in many ways. Such variations are not to be regarded as a departure from the spirit and scope of the disclosure, and all such modifications as would be obvious to one skilled in the art are intended to be included within the scope of the following claims.

What is claimed is:

1. A cooker comprising:

a casing defining an exterior of the cooker;

a cavity part disposed in the casing, the cavity part including a cooking chamber having an interior to receive food;

a burner disposed in the cooking chamber to burn a mixture gas of air and gas so as to supply energy to the interior of the cooking chamber;

a compartment member dividing the interior of the cooking chamber into a food cooking region and a gas mixing region where air and gas are supplied to form a mixture gas; and a door configured to selectively close or open the cooking chamber, wherein a portion of air flowing in the casing is supplied to the gas mixing region, wherein the portion of air is supplied to the gas mixing region through bottom and rear surfaces of the cavity part, and wherein a burner chamber is disposed at a lower side of the cavity part, the burner chamber being configured to supply high-temperature air to the food cooking region, and wherein air supplied to the gas mixing region through the bottom surface of the cavity part first passes through the burner chamber.

2. The cooker according to claim 1, wherein a heating source is disposed in the burner chamber to supply high-temperature air to the food cooking region of the cooking chamber.

3. A cooker comprising:

a casing defining an exterior of the cooker;

a cavity part disposed in the casing, the cavity part including a cooking chamber having an interior to receive food;

a broil burner disposed in the cooking chamber to burn a mixture gas of air and gas so as to supply energy to the interior of the cooking chamber for cooking food;

a compartment member dividing the interior of the cooking chamber into a food cooking region and a gas mixing region where air and gas are supplied to form a mixture gas;

a burner cover disposed at a lower side of the cavity part to define a burner chamber between a bottom surface of the cavity part and an inner surface of the burner cover;

a bake burner disposed in the burner chamber to heat air to be supplied to the food cooking region; and a door configured to selectively close or open the cooking chamber, wherein a portion of air flowing in the casing is supplied to the gas mixing region, wherein the broil burner and the bake burner are configured to be alternately operated, wherein an air supply hole is provided in the burner cover to connect an interior of the casing to the burner chamber, and wherein an air supply opening is provided in the cavity part to connect the burner chamber to the gas mixing region.

4. The cooker according to claim 3, wherein a second air supply opening is provided in the cavity part to connect the interior of the casing to the gas mixing region.

5. A cooker comprising:

a casing defining an exterior of the cooker;

a cavity part disposed in the casing, the cavity part including a cooking chamber having an interior to receive food;

a compartment member dividing the interior of the cooking chamber into a food cooking region and a gas mixing region where air and gas are supplied to form the mixture gas;

a burner including a mixing tube in which air and gas are mixed to provide the mixture gas, the burner being configured to burn the mixture gas to supply energy to the food cooking region;

a nozzle configured to inject gas into the gas mixing region; and a door configured to selectively close or open the cooking chamber, wherein, when the burner is operated, a portion of the air flowing in the casing is supplied to the gas mixing region to form the mixture gas and another portion of the air flowing in the casing is supplied to the food cooking region for combustion of the mixture gas, and wherein a first air supply opening is provided in the cavity part to supply air from an interior of the casing to the gas mixing region, and a second air supply opening is provided in the cavity part to supply air from the interior of the casing to the food cooking region.

6. The cooker according to claim 5, wherein a burner chamber is disposed at a lower side of the cavity part and air is supplied from the first and second air supply openings through the burner chamber.

7. The cooker according to claim 6, wherein a heating source is disposed in the burner chamber, the heating source being operated alternately with the burner to heat air supplied from the second air supply opening to the food cooking region.

8. The cooker according to claim 5, wherein the first air supply opening is provided in a rear surface of the cavity part to supply air from the interior of the casing to the gas mixing region.

9. The cooker according to claim 5, wherein a burner cover is disposed at a lower side of the cavity part to define a burner chamber in which a heating source is disposed, and wherein air is supplied from the interior of the casing to the food cooking region and the gas mixing region through the burner chamber.

10. The cooker according to claim 9, wherein the heating source is operated alternately with the burner, wherein the first air supply opening is provided in a bottom surface of the cavity part to supply air from the burner chamber to the gas mixing region and a heat supply opening is provided in the bottom surface of the cavity part so air heated by the heating source is supplied to the food cooking region, wherein, when the burner is operated but the heating source is not operated, air flowing in the burner chamber is supplied to the gas mixing region and the food cooking region through the first air supply opening and the heat supply opening, respectively, and wherein, when the burner is not operated but the heating source is operated, air heated in the burner chamber by the heating source is supplied to the food cooking region through the heat supply opening.

11. The cooker according to claim 10, wherein the second air supply opening is provided in a rear surface of the cavity part to supply air from the interior of the casing to the gas mixing region.

* * * * *